United States Patent [19]

Tucker

[11] Patent Number: 4,632,605

[45] Date of Patent: Dec. 30, 1986

[54] METHOD AND APPARATUS FOR REINFORCING AND CONSOLIDATING EARTH STRUCTURES

[75] Inventor: Michael C. Tucker, Brisbane, Australia

[73] Assignee: Gearhart Australia Limited, Queensland, Australia; a part interest

[21] Appl. No.: 629,089

[22] PCT Filed: Nov. 16, 1983

[86] PCT No.: PCT/AU83/00167

§ 371 Date: Jul. 13, 1984

§ 102(e) Date: Jul. 13, 1984

[87] PCT Pub. No.: WO84/01978

PCT Pub. Date: May 24, 1984

[30] Foreign Application Priority Data

Nov. 16, 1982 [AU] Australia ..... PF6836

[51] Int. Cl.[4] ..... E21D 20/00

[52] U.S. Cl. ..... 405/259; 405/258; 405/288; 52/155

[58] Field of Search ..... 405/258–262, 405/288, 15, 16, 19, 32; 299/11; 411/457; 52/155

[56] References Cited

U.S. PATENT DOCUMENTS

| | | | |
|---|---|---|---|
| 809,374 | 1/1906 | Holden . | |
| 1,559,560 | 11/1925 | Doughty | 405/260 |
| 2,398,130 | 4/1946 | Beijl | 61/45 |
| 2,667,037 | 1/1954 | Thomas et al. | 405/260 |
| 2,878,668 | 3/1959 | Starling et al. | 72/105 |
| 2,973,065 | 2/1961 | Cordes | 189/90 |
| 3,163,012 | 12/1964 | Dempsey | 405/259 |
| 3,427,811 | 2/1969 | White | 405/259 |
| 3,505,824 | 4/1970 | White | 405/259 |
| 3,509,726 | 5/1970 | White | 405/259 |
| 4,158,519 | 6/1979 | Gamlin | 405/260 |
| 4,265,571 | 5/1981 | Scott | 405/288 X |
| 4,413,928 | 11/1983 | Tucker | 405/260 |

FOREIGN PATENT DOCUMENTS

| | | | |
|---|---|---|---|
| 958262 | 11/1974 | Canada | 405/259 |
| 1115206 | 10/1961 | Fed. Rep. of Germany | 405/259 |
| 808500 | 2/1959 | United Kingdom | 405/259 |

*Primary Examiner*—Cornelius J. Husar
*Assistant Examiner*—Nancy J. Stodola
*Attorney, Agent, or Firm*—Renner, Otto, Boisselle & Lyon

[57] ABSTRACT

A reinforcing and or confining structure for an earth formation comprising a plurality of anchor members anchored at spaced intervals in an earth formation, the anchor members being connected to the adjacent anchor members by tensile members to form a substantially continuous tensile member adjacent the surface of the ground formation. Point loads resulting from earth movements are dissipated as a tensile load throughout the system. The anchor members may be tensionable to reinforce the earth formation. The tensile elements may be formed integrally with the anchor members in a substantially L-shaped configuration or they may be separate therefrom. The substantially continuous tensile members may be formed in spaced parallel rows or they may overlap or be interconnected to form a mesh-like structure.

22 Claims, 31 Drawing Figures

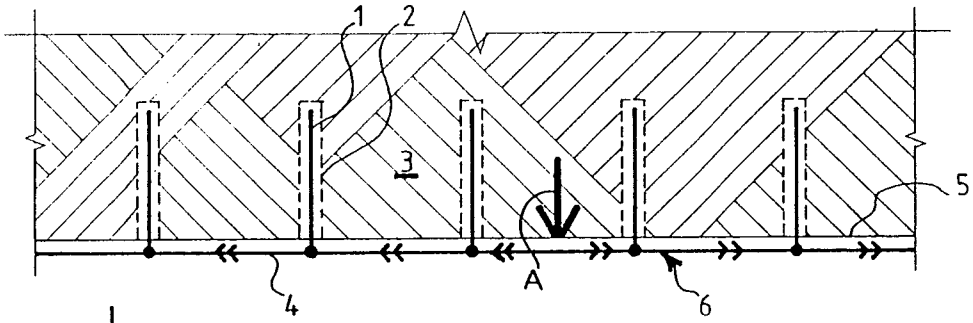
FIG. 1
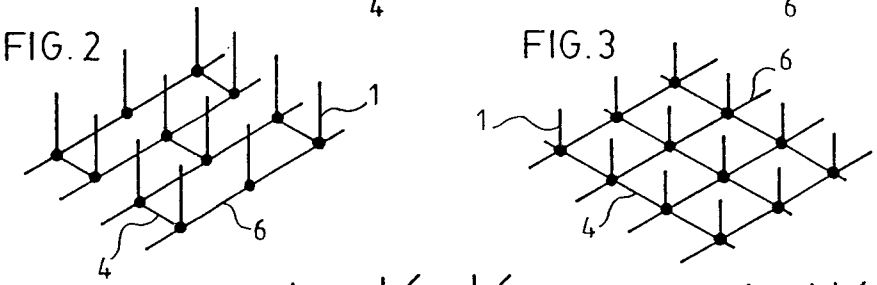
FIG. 2
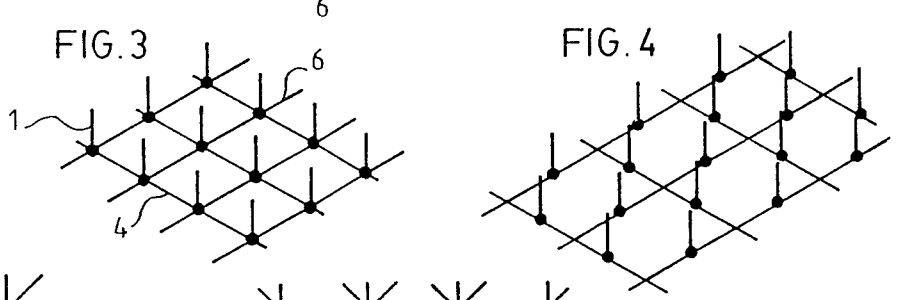
FIG. 3
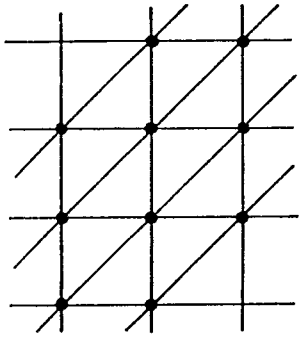
FIG. 4
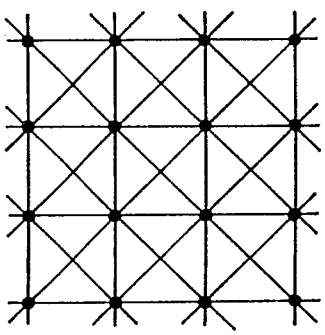
FIG. 5
FIG. 6

METHOD AND APPARATUS FOR REINFORCING AND CONSOLIDATING EARTH STRUCTURES

This invention is concerned with a method and apparatus for reinforcing and consolidating earth structures such as mine shafts and tunnels.

Where a tunnel or drive penetrates an earth structure it is often necessary to reinforce or otherwise confine the wall surfaces (including the roof) against collapse. Reinforcement or confinement has been achieved by steel or timber shoring members and props or fabricated arch members, but these are expensive and unsatisfactory for modern day mining techniques, particularly given the rates of tunnelling now possible. These are known as "passive" support systems as they only become effective once the earth formation fails and collapse occurs.

Of recent years dynamic support of tunnel surfaces (particularly the roof) has been achieved by the use of devices generally known as rock anchors or roof bolts. A plurality of bore holes are drilled to a desired depth in the roof, generally transversely of the direction of progress of the tunnel. The roof bolts are then inserted into the bore holes and are anchored, either by mechanical means such as wedging or by grouting with chemical or cementitious materials, at their remote inner ends. The end of the bolt adjacent the bore hole opening is screw threaded such that with the aid of a large washer and a threaded nut, the bolt may be tensioned. Tensioning of the bolts in this manner creates zones of compression within the earth structure surrounding the bolts. By carefully selecting the bolts spaced overlapping compression zones can be achieved to create, in effect, a reinforced arch structure.

In earth formations where the mechanical properties of the formation would require very close spacing of bolts, reinforcement is achieved by bolting a steel strap to the wall surface with rock bolts intermediate the ends of the girder. These straps (which may include reinforcing ribs or channels) are generally arranged transversely of the direction of progress of the tunnel and, if required, may include props adjacent the ends of the strap. Such straps may be of any suitable length but, in general, do not exceed six meters as they become too difficult to handle.

With the combination of compression zones and supported zones, a dynamic reinforced arch is thus created.

The use of steel straps in conjunction with roof bolts is generally confined to soft, crumbly or highly faulted earth formations such as coal seams, fragmented rock etc., or areas which may be subjected to high induced stresses as a result of adjacent mining action.

In either of the abovementioned "dyanmic" systems, support or reinforcement against earth formation outbursts is confined to a plurality of adjacent transverse "arches". If the region surrounding one or more of the rock bolts fails, tension in the rock bolt can reduce to zero with the result that the integrity of the reinforced "arch" fails with the likelihood of collapse. Further, if a reinforced "arch" fails or collapses, the stress release in the earth formation can cause adjacent "arches" to lose their integrity with a resultant massive collapse.

Neither of the above systems of earth formation reinforcement permits dissipation of outburst stresses to any substantial degree whereby the outburst can be resisted or supported against collpase. The steel strap may support very small portions of loosened earth formation in the immediate vicinity of the strap but no meaningful support is available between adjacent straps. Steel straps are generally constructed of light gauge steel and obtain a degree of flexural rigidity from being rolled or otherwise formed into a corrugated cross-section, generally conforming to a "W" in shape. These straps do not fully utilize the potential tensile strength of such a relatively large mass of steel. Firstly, it is not known in mining practice to interconnect these straps (apart from patterns of say two lengths at tunnel intersections) to form an elongate tensile member of "substantially continuous" length (hereinafter defined). Thus in use, the ability of the strap to support an earth mass is dependent entirely on the anchoring member and the flexural strength imparted by the cross-sectional deformation. Secondly, even if such straps were to be connected in "substantially continuous" lengths, the effective tensile strength then becomes a function of the resistance to tearing in the region where the anchor passes through the strap. Accordingly, only a relatively small portion of the cross section of the strap is utilized when a rock-bolted strap is subjected to a tensile load parallel to an earth face against which it is mounted.

In the event of an outburst there is no increase in stress on the rock bolts of a simple compression "arch" rather the tension in the bolts is released. Where a strap is employed with rock bolts, an outburst may increase the tension in the bolts and apply a flexural load to the strap itself but, the only dissipation of stresses which can occur is within the discrete strap/arch structure and not to the surrounding regions.

A further disadvantage relating to known reinforcement systems is that in the event of an outburst there is substantially no inherent ability to confine and restrain loosened material from falling.

It is known to use either a welded wire mesh or a chain wire mesh in conjunction with tensionable rock bolts in an endeavour to confine earth masses which might otherwise fall from between those regions "reinforced" by the rock bolts. Because of the difficulties in overhead handling of relatively large panels of mesh in relatively confined spaces it is customary to use small panels. Accordingly the tensile elements comprised in the mesh panels are effectively discontinuous over any substantial area. This lack of tensile continuity will, under outburst conditions, enable considerable convergence of the earth mass with the result that there is a general loss of integrity in the stressed area which can ultimately lead to loss of anchorage in the rock bolt as convergence continues.

It is an aim of the present invention to overcome or alleviate the disadvantages of prior art earth formation reinforcement systems and to provide a reinforcement system with inherent confinement ability.

According to one aspect of the invention there is provided a method of reinforcement of earth formations against convergence comprising the steps of:-anchoring a plurality of anchor members in an earth formation; and connecting tensile elements between adjacent anchor members to form a substantially continuous tensile member adjacent the surface of the earth formation, whereby in use a force generated by said earth formation is distributed as a tensile stress in said substantially continuous tensile member.

Preferably said anchor members comprise tensionable anchor members.

Preferably said anchor members comprise rock bolts anchorable in a bore hole by mechanical means.

Preferably said anchor members comprise rock bolts anchorable in a bore hole by grouting composition.

Preferably the normally free ends of said anchor members are adapted for substantially rigid connection to said tensile elements.

Preferably said tensile elements are integrally formed with said anchor members.

Preferably said tensile elements are connected to said anchor members to form a linear substantially continuous tensile member.

Preferably said tensile elements are connected to said anchor members to form one or more multi-directional substantially continuous tensile members.

Preferably said tensile elements are connected to said anchor members to form a net-like multi-directional substantially continuous tensile structure.

Preferably a plurality of tensile elements are connected to a plurality of said anchor members to form a net-like multi-directional substantially continuous tensile structure.

According to another aspect of the invention there is provided a reinforcing and/or confining structure for an earth formation comprising a plurality of anchor members anchored at spaced intervals in said earth formation, at least some of said anchor members being connected to adjacent anchor members by tensile elements to form a substantially continuous tensile member adjacent the surface of said ground formation.

Preferably, a plurality of said tensile elements are connected to anchor members to form a net-like substantially continuous tensile structure.

According to yet a further aspect of the invention there is provided an anchor member comprising an insertable portion for anchoring in an earth structure and a normally free portion adapted for connection to a tensile element.

Preferably said tensile element is formed integrally with said anchor member.

Preferably said anchor member is tensionable within a bore hole.

According to yet a further aspect of the invention there is provided a tensile element for connection between anchor members comprising a body portion and means for connection to at least one anchor member.

Preferred embodiments of the invention will now be described with reference to the accompanying drawings in which:

FIG. 1 is a cross sectional view showing schematically installation of a tensile member in an earth formation.

FIGS. 2–6 show a number of alternative arrangements.

Figure 10:
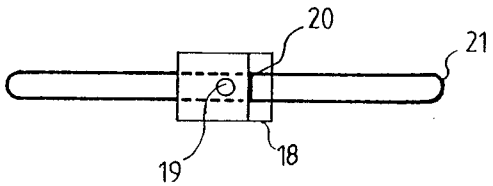
FIGS. 8–15 show alternative embodiments of tensile elements according to the invention.

In FIG. 1, anchor members 1 such as rock bolts are anchored in bore holes 2 in an earth formation 3 such as the roof or walls of a mine shaft, tunnel or the like.

Between adjacent anchor members 1 are rigidly connected tensile elements 4 adjacent the surface 5 of the earth formation. The generally rigid tensile elements 4 are connected to the anchor members 1 in such a manner as to form a substantially continuous tensile member 6 extending over the surface 5 of the earth formation.

In the event of a rock outburst, strain release within the earth formation generates or is accompanied by a convergent force, generally shown by arrow A in a direction outwardly from the earth surface. As the tensile member 6 is situated substantially against or adjacent the surface 5, the convergent force is distributed almost immediately as a tensile force into the tensile member 6 shown by the double arrows.

It will be noted that, with the possible exception of immediately adjacent anchor members, the only force applied to the anchor members is a shear force. Generally speaking there is substantially no tensile force applied to the anchor members which might otherwise pull the anchor members out of their bore hole or at least weaken the retention of the anchors.

It will be noted also that as the convergent or outburst force is dissipated directly into the tensile member 6, the determinant factor for withstanding outburst forces is the tensile strength of the tensile member.

Thus not only does such a structure reinforce an earth formation but it also serves to confine weakened earth masses against collapse. It is believed that the dissipation of the outburst force as a tensile stress in the tensile member enables the reinforcing and confining properties of the present invention to be largely independent of the nature of the earth formation. This contrasts markedly with all known earth formation reinforcing systems which are substantially discontinuous in nature.

The anchor members which may be employed with the present invention may comprise any of the presently used rock bolts. Rock bolts are generally divided into two main categories—mechanically anchored, i.e. wedges, or grout retained, i.e. by chemical or cementitious grouts. These rock bolts are tensionable by a threaded nut on the free end of the bolt to create a compression zone in the earth formation. The threaded nut on the free end enables ready mechanical connection of a tensile element between adjacent rock bolts to form a generally rigid substantially continuous tensile member. As described later the tensile elements may be associated with the bolts directly or with a washer or plate clamped between the nut and the earth surface. The anchor member may also comprise a mechanical wedge, the subject of co-pending Australian Patent Application No. PG 1404, the contents of which are incorporated herein by reference.

Although in some circumstances it may be desirable to reinforce the earth formation by tensioning at least some of the rock bolts, the main function of the bolts (anchoring means) is to retain the resultant tensile member closely adjacent the surface of the earth formation. Accordingly immense cost savings could be achieved by reducing both the length and gauge of the bolts. In addition, less sophisticated (and thus less expensive)

mechanical retaining means or grouting systems are also possible.

Generally linear tensile members as shown in FIG. 1 could be arranged longitudinally of a tunnel or shaft either singly or in spaced rows depending on the nature of the earth formation. Alternatively the linear tensile members could be arranged helically within the tunnel extending, from one wall, over the roof to the opposite wall. For additional reinforcement and confinement, the linear tensile members may be interconnected or even crossed.

Alternative configurations exemplary of an almost unlimited variety of patterns are shown generally in FIGS. 2–6.

In FIG. 2 the arrangement comprises a plurality of linear tensile members interconnected at alternating anchor members.

In FIG. 3 a mesh-like structure is formed by interconnecting all adjacent anchor members.

The arrangement of FIG. 4 comprises a mesh-like structure in which linear tensile members are overlaid or interwoven but not connected at the intersections.

FIGS. 5 and 6 show mesh-like structures comprised respectively of three and four axes of linear tensile members. These structures may be overlaid, interwoven and/or interconnected at some or all of the intersections of linear tensile members.

Figure 7:
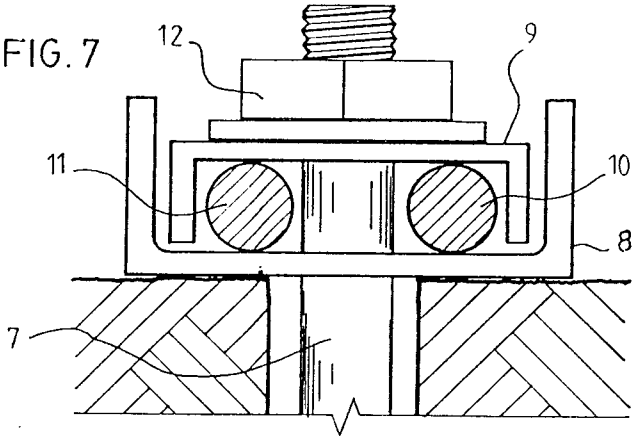
FIG. 7 shows one embodiment of an anchor member according to the invention.

FIG. 7 illustrates an alternative embodiment of the invention. A rock bolt 7 is anchored into a bore hole by any convenient means. Over the protruding threaded stem of the bolt is placed a length of channel 8 with webs facing outwardly from the surface of the earth formation. The channel includes an aperture through which the stem of the bolt passes. A tensile element 10 comprising a wire rope, cable or steel rod is then clamped into the channel recess by a second inverted channel section 9 which locates within the recess of channel 8. The rock bolt is then tensioned by a nut and washer assembly 12. Tensioning of the rock bolt rigidly clamps tensile element 10 into a locked relationship with the bolt. By interconnecting the tensile element to adjacent tensionable rock bolts there is obtained a substantially continuous tensile element extending over the surface of the earth formation. If required, additional tensile strength may be obtained by using a second tensile element 11 extending parallel to first tensile element 10. Alternatively the arrangement may be employed as a means for connecting the terminations of separate tensile elements or it may be employed to permit interconnection between adjacent arrays of tensile elements.

For interconnections of linear tensile members or for formation of multi-directional or mesh-like structures, a number of connecting tensile elements are shown in FIGS. 8–14.

Figure 8:
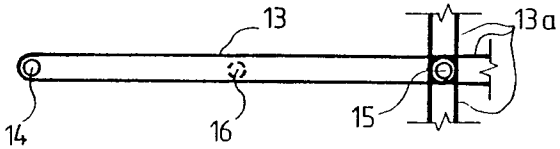

In FIG. 8 the tensile element comprises simply a continuous elongate loop 13 of rod or bar steel formed by welding the ends. The loop may be of any suitable length but generally will represent the spacing of adjacent anchor members or twice that spacing. In the embodiment shown the loop is placed over the free ends of adjacent rock bolts 14, 15 to form a tensile element therebetween. A rigid connection between bolts 14 and 15 is achieved by adding a washer and nut (not shown) to the free ends of the bolts and either tightening the nut or tensioning it. Interconnections between other rock bolts are achieved in a desired manner by connecting further loops 13*a* in the manner described above.

In the case where the length of the loop represents twice the normal rock bolt spacing, the loop may bridge an intermediate bolt shown in phantom at 16. This intermediate bolt may also form the pont of intersection of two or more of such loops.

Figure 9:
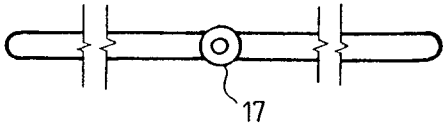

FIG. 9 illustrates a modification of the device of 8 in which a plate or washer 17 is attached intermediate the ends of the loops. If required a loop may be attached on either side of washer 17 to form a cruciform member.

FIG. 10 illustrates a tensile link element with an adjustable centre connection. The centre connection comprises a plate or washer 18 with a bolt aperture 19 and a slit 20. The edges of the slit are displaced relative to each other to permit loop 21 or other tensile element to be slidably located therein. In this manner the position of the centre bolt may be varied as required. It is considered important to restrain the limbs of the loop against sideway movement under load as otherwise they could be forced out from under the intermediate plate 18 and thus lose support.

Figure 11:
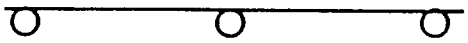

FIG. 11 shows a tensile element shaped from rod on bar steel.

Figure 12:
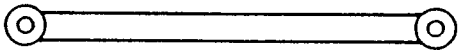

FIG. 12 shows an element with integrally formed eyes at either end.

Figure 13:
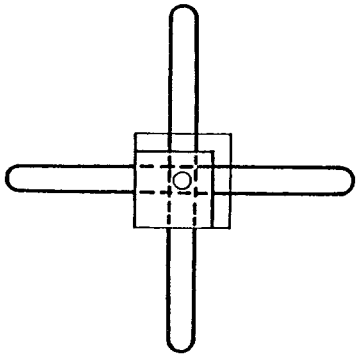
Figure 14:
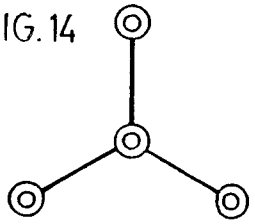

FIGS. 13 and 14 show multi directional variations of the elements of FIGS. 10 and 12 respectively.

Figure 15:
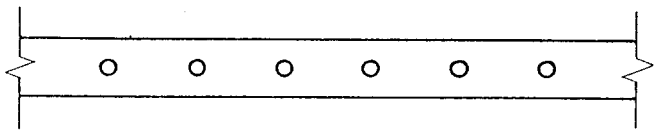

FIG. 15 illustrates a most preferred embodiment comprising flat bar steel punched at appropriate intervals to accommodate varying anchor spacings. The punched steel strip may be supplied conveniently in fixed lengths as flat strip or could be provided in coil form.

Figure 16:
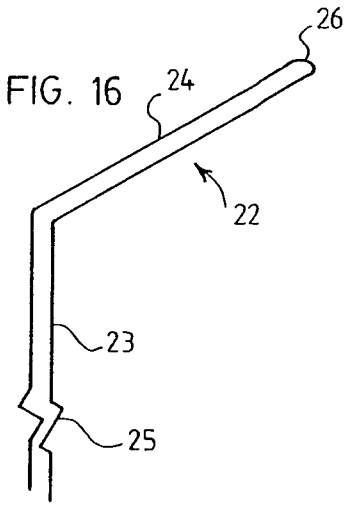
FIG. 16 shows a combination anchor/tensile element.

FIG. 16 illustrates a combined anchor member/tensile element 22 formed from a length of steel rod. The member 22 is formed by shaping the rod into a U-shaped member and then bending the U-shaped member at a desired position intermediate its length to form an inverted L-shaped member. Member 22 thus comprises an anchor portion 23 and a tensile element portion 24. Anchor portion 23 can be mechanically retained in a bore hole by forming links 25 or the like. If a more positive anchoring is required anchor portion 23 (or at least the free end thereof) can be retained in a bore hole by a grout. An anchored tensile member can be formed by locating subsequent bore holes for successive units inside and adjacent the end of loop 26 at the outer free end of each U-shaped member 22. In this manner a substantially continuous tensile member may be formed.

Figure 17:
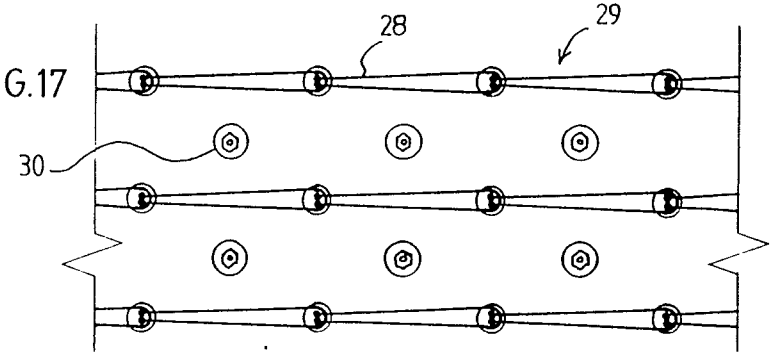
FIGS. 17–18 show the use of tensile members in accordance with the invention in conjunction with conventional rock bolts.

FIG. 17 shows an alternative reinforcing and confining structure comprising an array of substantially continuous tensile members in conjunction with conventional rock bolts. Tensile elements 28 such as those illustrated in FIG. 16 are suitably formed as spaced, anchored substantially continuous tensile members 29 and are arranged longitudinally of the walls of a tunnel or the like. Rock bolts 30 are arranged in any suitable pattern in the spaces between members 29 to combine the advantages of both types of structure. Preferably, the rock bolts are arranged so as to create, when tensioned, a plurality of spaced compression arches transversely of the tunnel.

Figure 18:
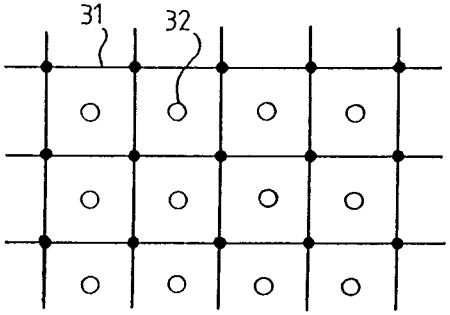

FIG. 18 illustrates yet a further configuration comprising an anchored net-like tensile structure 31 in combination with conventional roof bolts 32.

It will be readily apparent to a skilled addressee that many differing patterns, configurations and combinations of anchoring devices and tensile elements can be arranged to suit the particular requirements of an earth formation.

Figure 19:
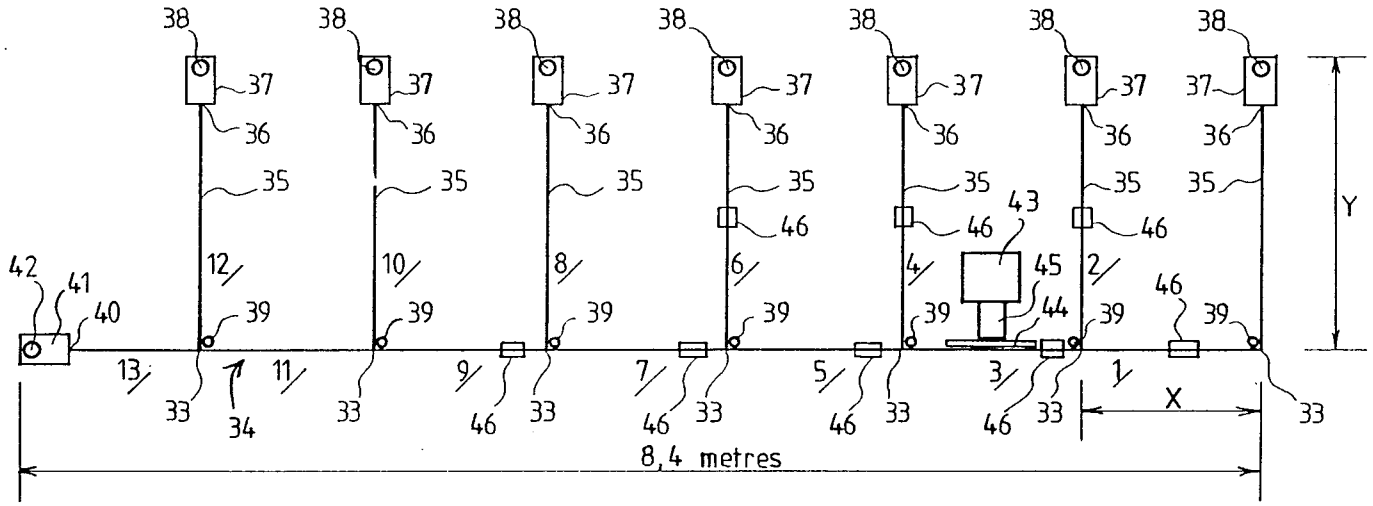
FIG. 19 illustrates the layout for a test procedure.

FIG. 19 illustrates a simple test which can be carried out to demonstrate the effectiveness of the invention and to compare the various embodiments thereof.

Portions of 6 mm diameter steel rod were arranged on a flat concrete surface in the configuration shown. Dimension y represented a distance of 2·0 meters consistent with the depth of insertion of a rock bolt in a bore hole. Dimension x was 1·2 meters and is typical of anchor spacing.

Intersections 33 were each welded to form the analogue of a substantially continuous tensile member 34 attached to anchor members 35. The free ends 36 of the anchor members 35 are welded to steel plates 37, which in turn are secured to the concrete surface by masonry anchors 38. This is analogous to securing rock bolts in a bore hole.

Steel pins 39 of approximately 25 mm diameter were embedded into the concrete surface with portion of the pin protruding upwardly to locate the intersections 33. This was intended to be analogous to the location of an intersection at the entrance to a bore hole. The end 40 of substantially continuous tensile member 34 was welded to a steel plate 41 in turn secured to the concrete surface by a masonry anchor 42.

An hydraulic ram 43 was firmly secured to the concrete surface by masonry anchors and a steel plate 44 was placed between piston 45 and tensile member 34 to act as a load spreading member.

Strain gauges were then attached to "tensile elements" 1,3,5,7, and 9 and the "anchor members" 2,4, and 6.

Hydraulic ram 43 was then actuated to create a set of conditions analogous to a strain release in the surface of an earth formation such as a tunnel, shaft or the like. The strain values detected by strain gauges 46 were recorded and presented graphically as shown in FIGS. 20–27.

Figure 20:
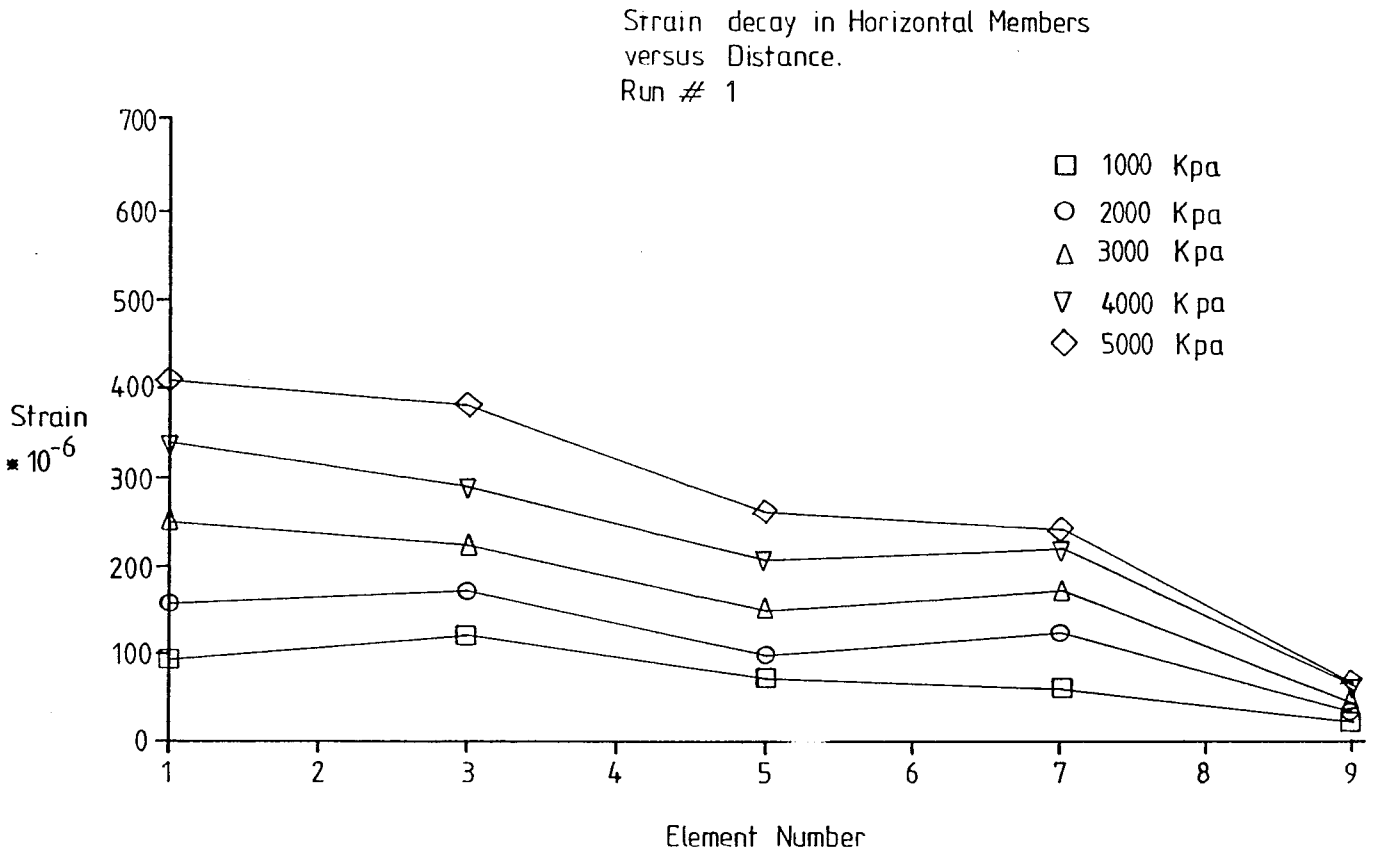
FIG. 20–27 are graphical representations of test results obtained from the arrangement of FIG. 19.
Figure 21:
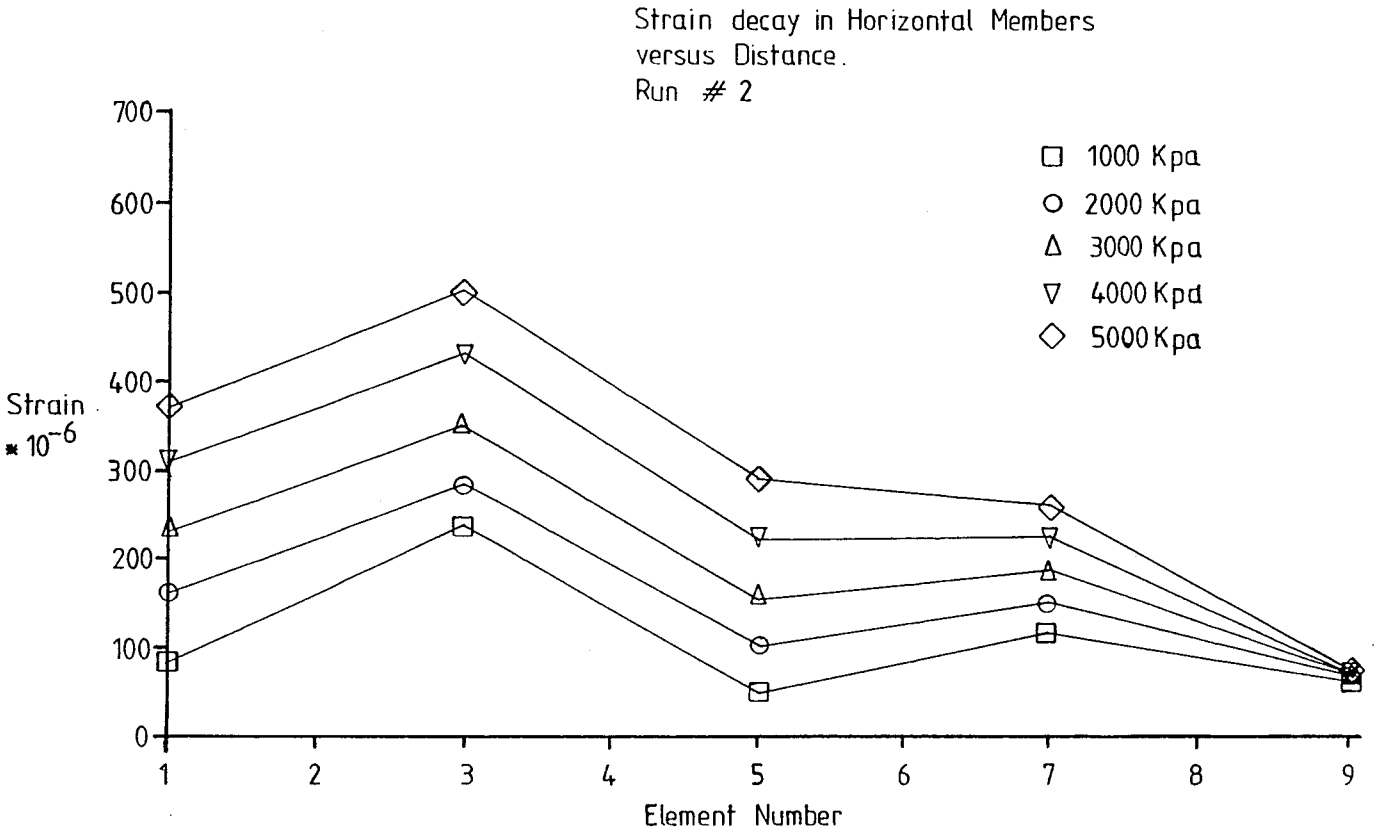

FIGS. 20 and 21 illustrate strain decay in the tensile elements as a function of distance from the force applied. It can be seen clearly that strain decays rapidly in the tensile member over a relatively short distance even for a wide range of applied forces.

Figure 22:
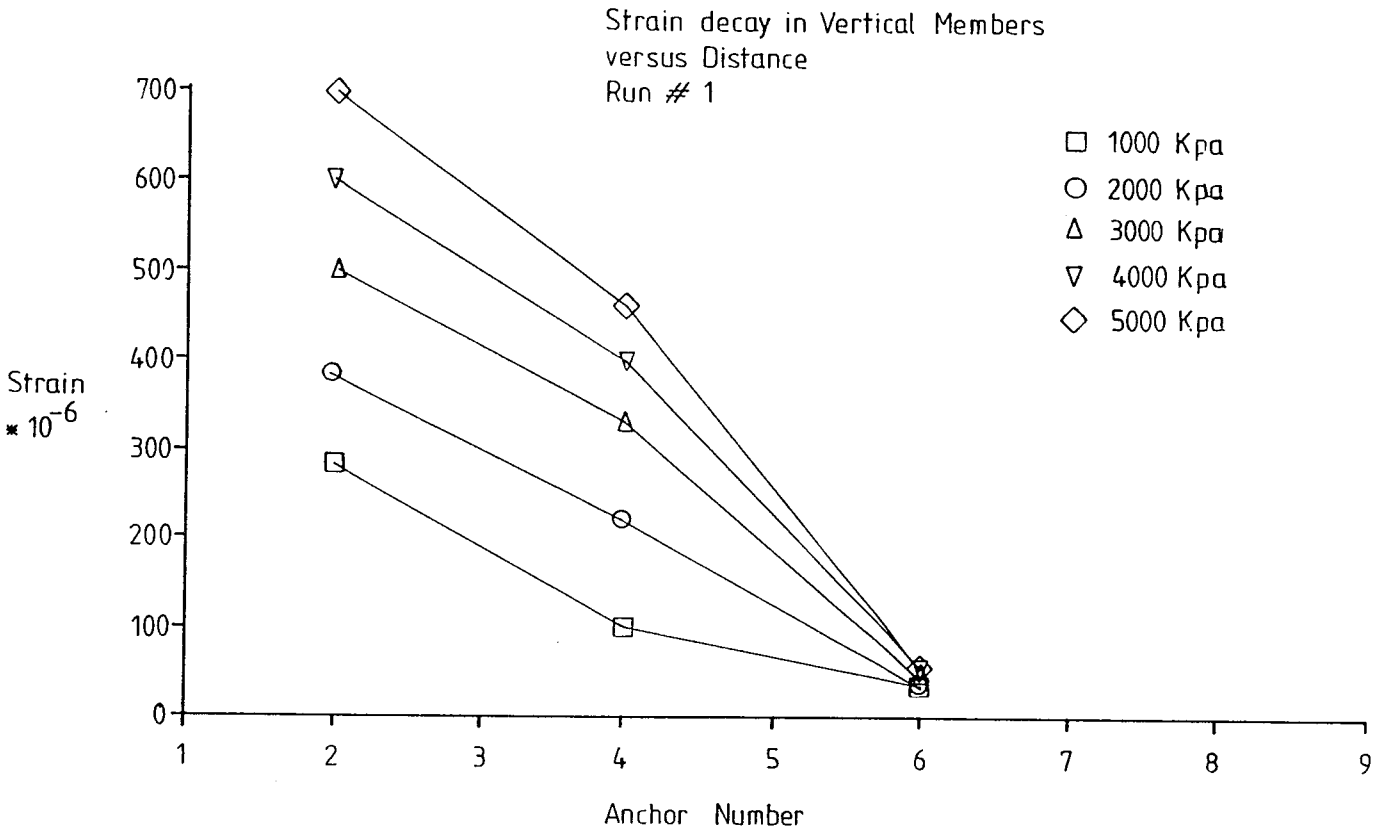
Figure 23:
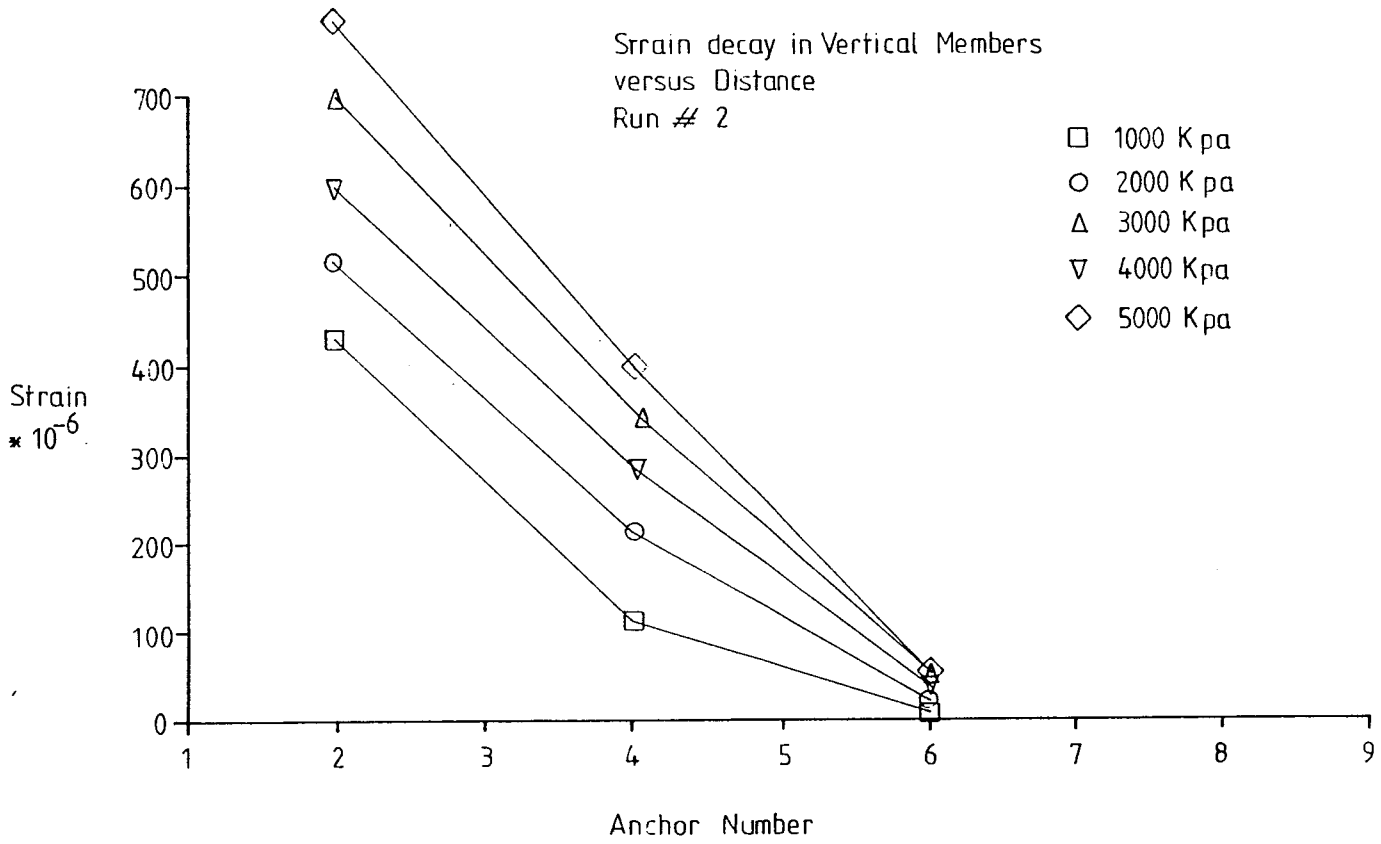

FIG. 22 and 23 illustrate similar characteristics for the anchor members.

The rapid decay of strain vs distance from load applied indicated that an outburst force (which is substantially perpendicular to the surface of an earth formation or at least has a substantial perpendicular vector) is restrained by a resultant tensile reaction in the tensile structure parallel to the surface of the earth formation. The rapid decay of tensile forces is considered to occur as a result of compressive forces applied in the earth formation adjacent the surface thereof.

In the event of a burstout there is thus considered to be an active reinforcement as well as an active and passive support to the earth formation. As the resultant of the outwardly directed (convergent) burstout force is a lateral compressive force, reinforcement of the earth formation occurs.

Both the reinforceing and confinement properties of the invention are considered to arise from the substantially non-yielding and rapidly reacting nature of the substantially continuous tensile structure.

As used throughout this specification, the term "substantially continuous" refers to the interconnection of tensile elements to form substantially rigid tensile members or structures over distances of say more than 15 meters of an earth formation surface "substantially continuous" tensile members are distinguished in the present invention from steel or timber reinforcing beams or "W" straps which have been hitherto used in lengths up to 6 meters but have not been interconnected to form a "substantially continuous structure".

Figure 24:
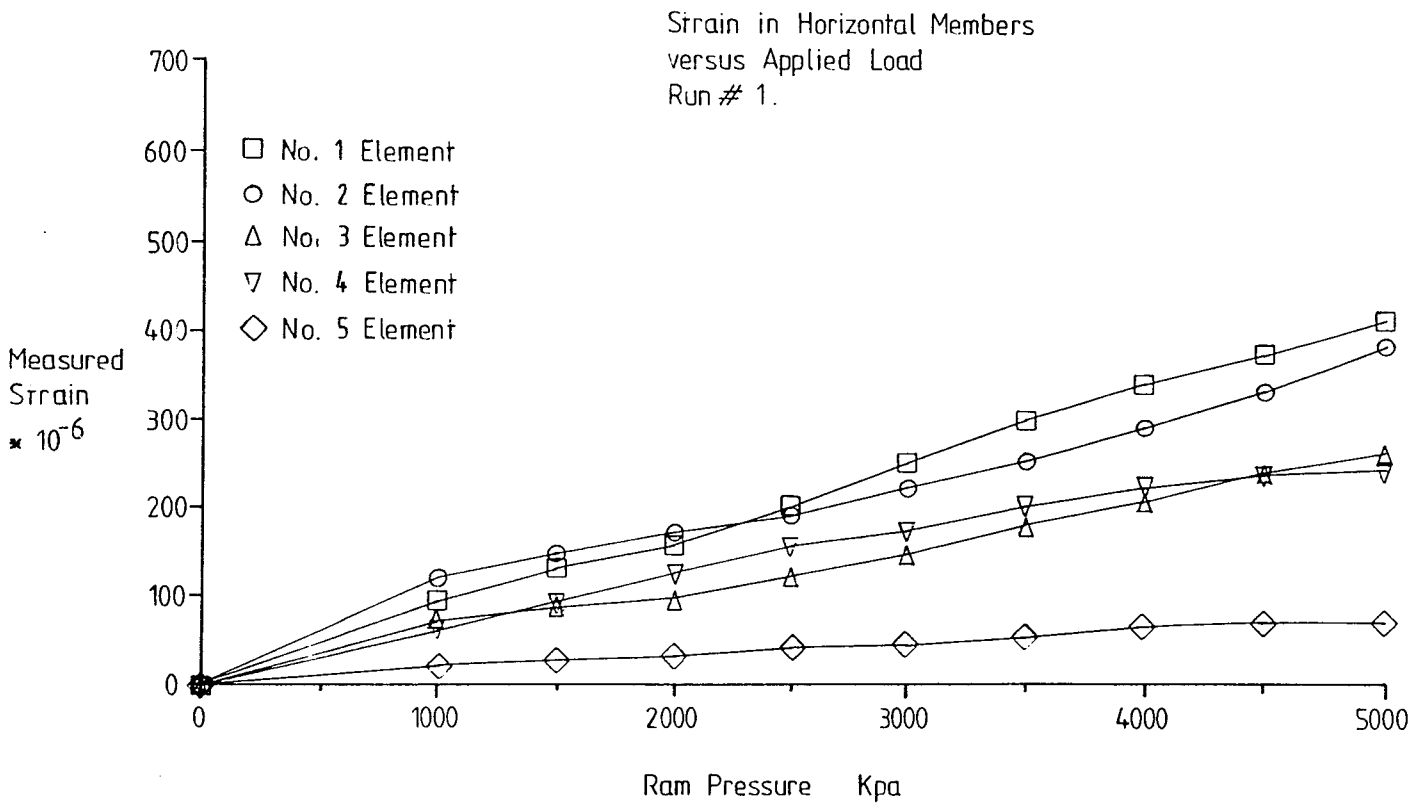
Figure 25:
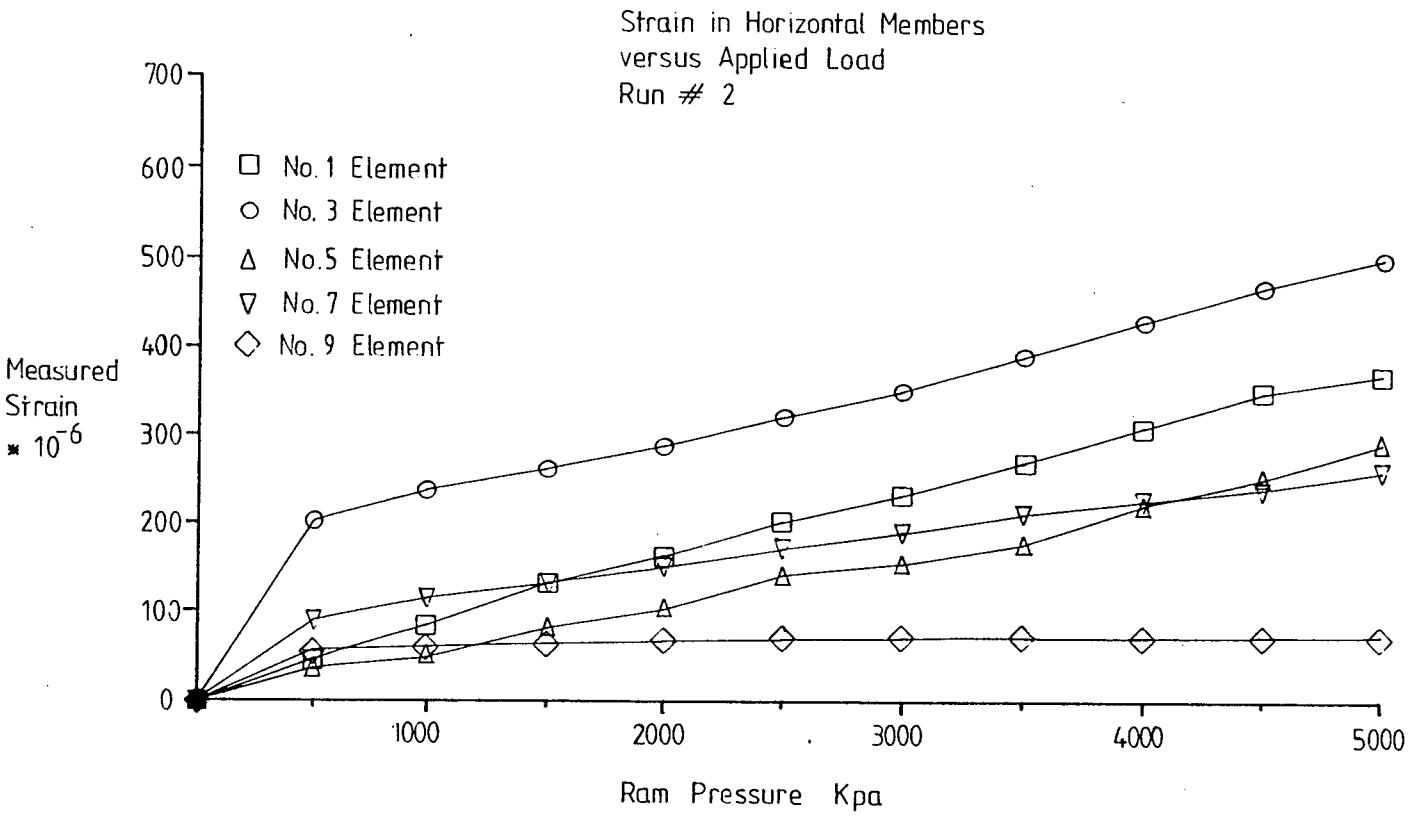

FIGS. 24 and 25 show values of strain in the individual tensile elements as a function of load applied. Expectedly, those tensile elements closest the force applied show a substantially directly proportional rate of increase of strain. The rate of increase of strain decays rapidly as the distance increases from the point of applied load. The substantially constant strain value in element 9 suggests that the tensile structure may be capable of withstanding immense loads regardless of load applied. Accordingly, the main determinant in load bearing capabilities of such a structure would be the tensile strength of the tensile elements.

Figure 26:
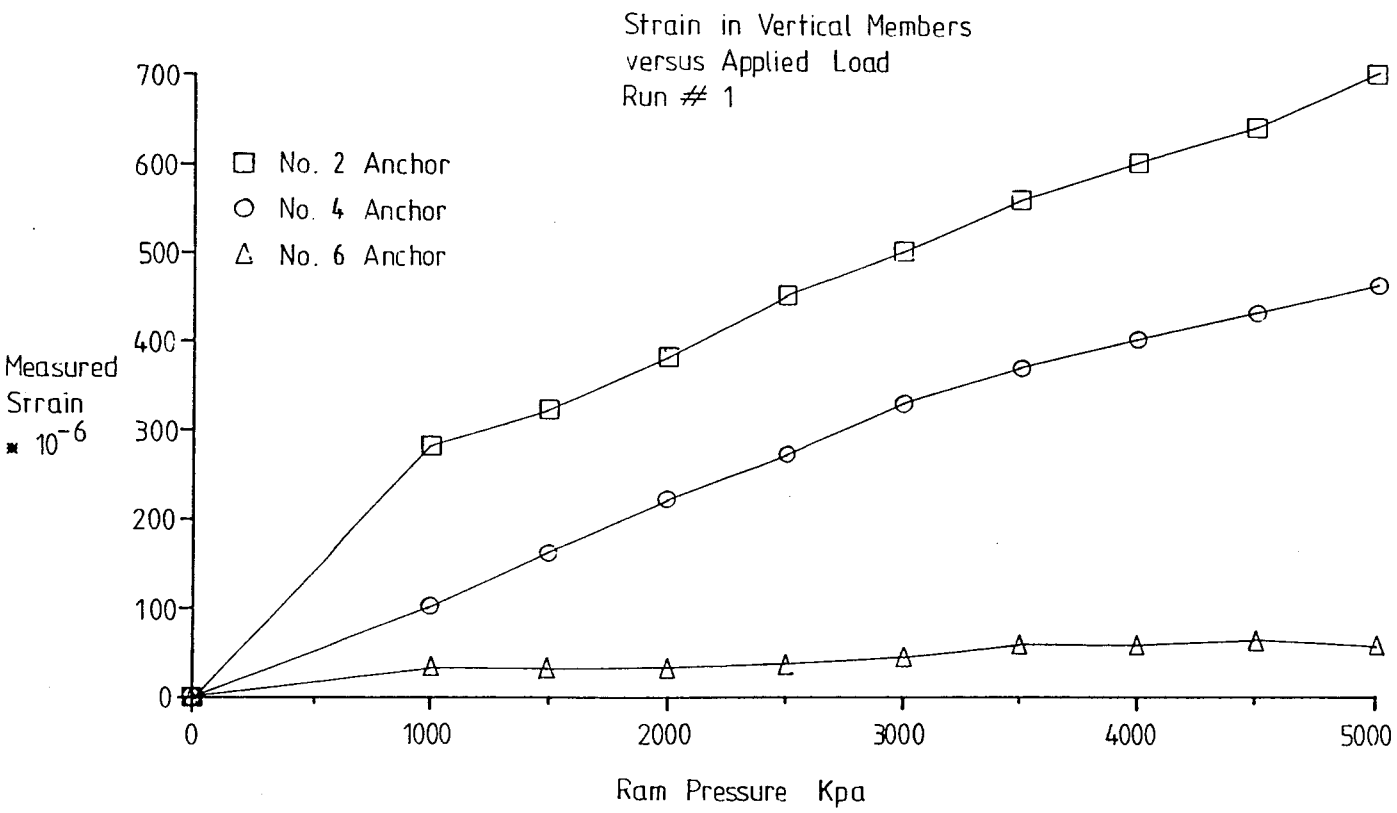
Figure 27:
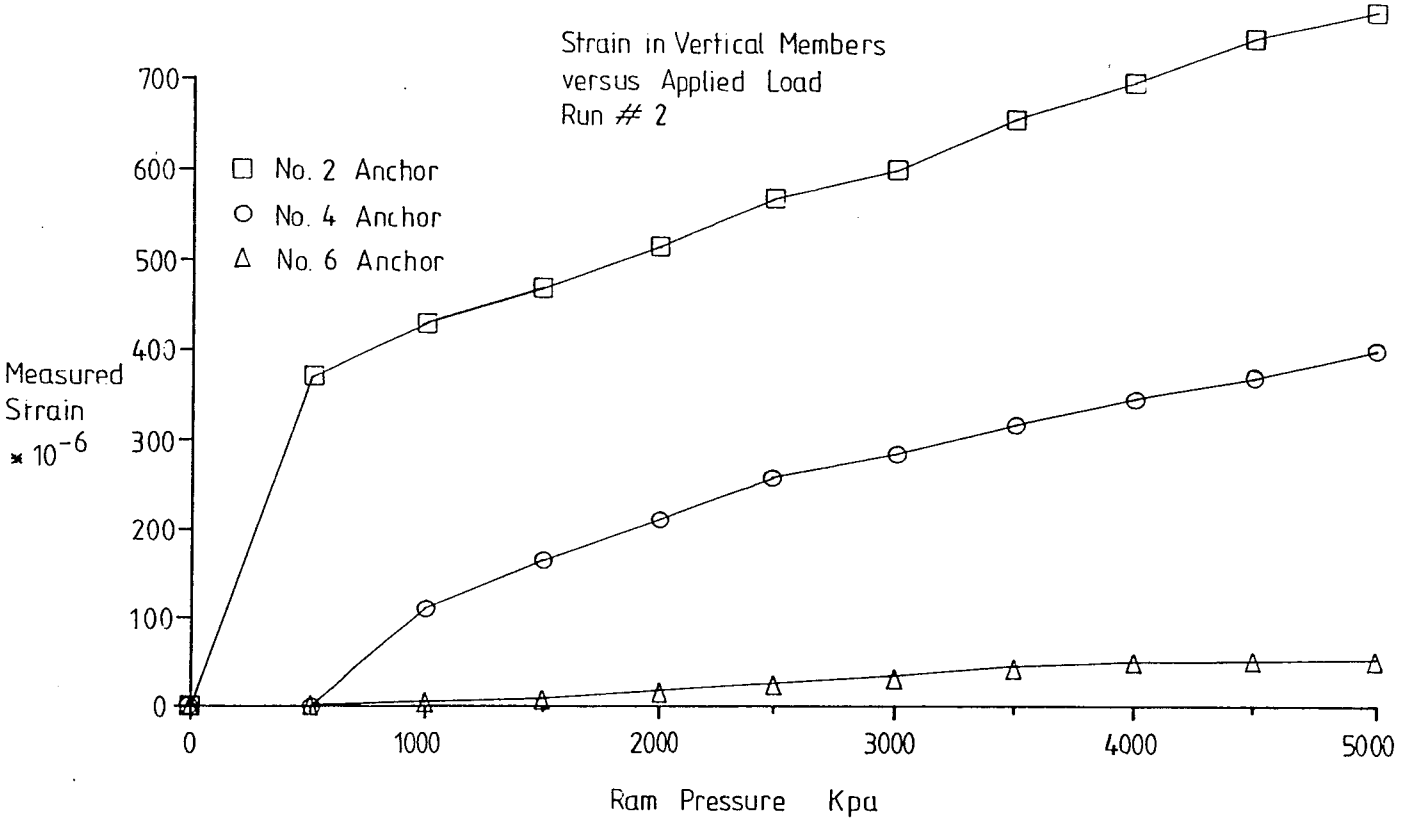

FIGS. 25 and 26 show similar values of strain in the anchor members versus applied load.

The test results illustrated in FIGS. 20–27 clearly demonstrate the efficacy of the present invention to reinforce and confine earth formations.

Figure 28:
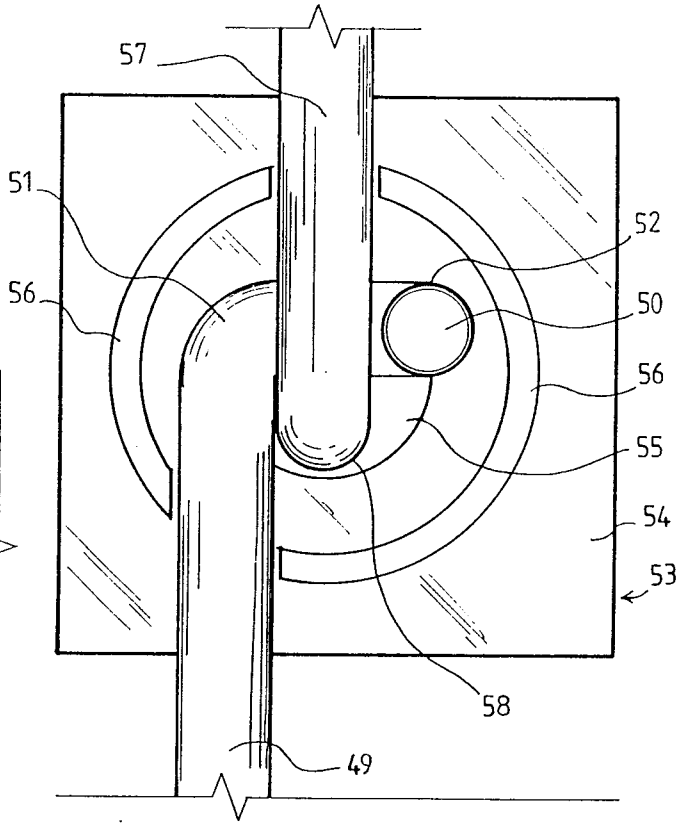
FIG. 28 is a plan view of the linkage between adjacent members of an alternative form of a tensile element according to the invention.

FIG. 28 illustrates yet another form of tensile element according to the invention. The element comprises a generally L-shaped length of steel rod which may have a smooth or deformed surface. One limb of the L-shaped member comprises an anchor member (not shown) for insertion into a bore hole for anchoring by grouting or mechanical means. The other limb 49 of the L-shaped member comprises a tensile member adapted to lie adjacent an earth surface. The free end 50 of the limb comprising the tensile member has a first bend 51 in the same plane as the earth surface against which it lies and a second bend 52 in a direction normal to the plane of the earth surface and away therefrom.

To install this type of tensile element a bore hole is formed and the anchor limb of the L-shaped element is suitably anchored in the bore hole. In the region of the crook of first bend 51 a second bore hole is drilled. A base plate 53 comprising a base 54 with a central aperture 55 and raised walls 56 is then located between the end of the tensile element and the earth surface with the aperture 55 aligned with the bore hole.

The anchoring limb of a second tensile element 57 is then inserted through aperture 55 into the bore hole for anchoring therein.

Figure 29:
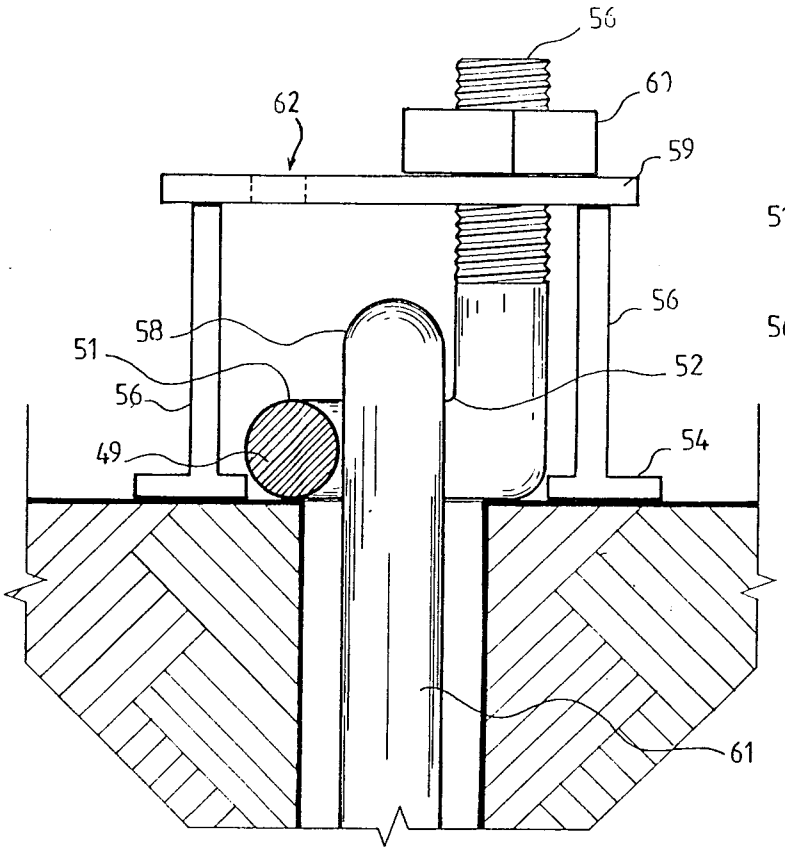
FIG. 29 is a front elevational view of the arrangement of FIG. 28.

As shown in FIG. 29 the bend 58, between the insertable limb and the tensile limb of element 57, fits snugly into the respective crooks of bends 51 and 52. A further plate 59 having an aperture for the free end 50 of limb 49 is placed over the aperture and the entire arrangement is tensioned by means of threaded nut 60. It will be seen that tensioning of nut 60 will cause tension to be induced into anchoring limb 61 of tensile element 57 as well as the tensile limbs of both tensile elements 49 and 57. Substantially continuous anchored tensile members may thus be constructed over the surface of an earth formation with both the anchoring portion and the tensile portion in a state of tension.

The arrangement described above is considered to be particularly suitable for softer or fractured earth formations such as coal seams wherein initial reinforcement of the formation may be induced in a manner similar to conventional rock bolt or rock bolt/steel strap technology. This arrangement offers the additional advantage that if the anchoring reinforcement fails then dynamic confinement reinforceing of the earth formation takes over.

If required, a further aperture 62 may be included in plate 59 to enable injection of a grout material to rigidify the intersection of adjacent tensile elements.

The tensile elements illustrated in FIGS. 28 and 29 may be arranged in staright linear arrays or, possibly, in a zig-zag formation due to the ability of the intersection between adjacent tensile elements enabling relative rotation through about 120°.

Figure 30:
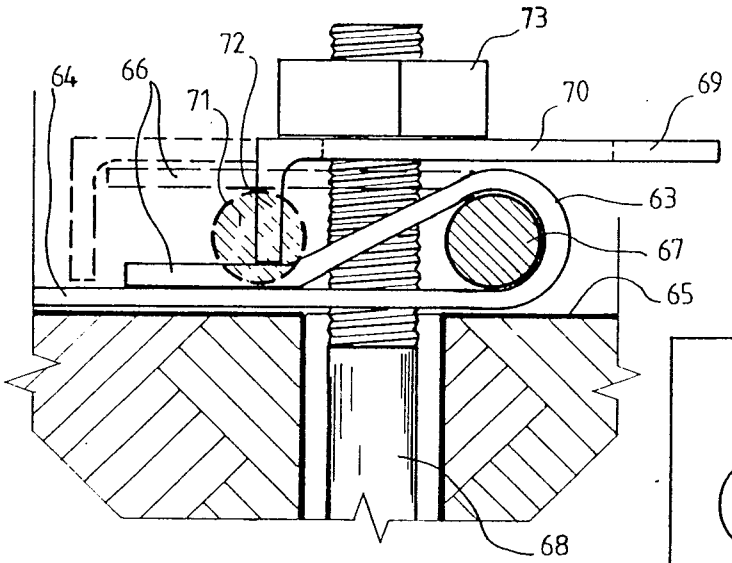
FIG. 30 is a side elevational view of a link means between a tensile element and an anchor member.

FIG. 30 shows an alternative embodiment of the arrangement illustrated in FIG. 7.

A compression member 63 comprises an apertured U-shaped plate with a base 64 which engages against an earth surface 65. The outer leg 66 (shown in phantom in its initial position) is spaced from base 64 at a distance to neatly accommodate a tensile member 67. Member 63 is apertured to receive the free end of a rock bolt 68 therethrough. A clamp member 69 comprises an angle section member having a slotted aperture 70 to receive the free end of rock bolt 68 to enable clamp member 69 to slide between an extended position (as shown in phantom) whereby a further tensile member 71 (also shown in phantom) may be clamped, and a retracted position as shown.

When a single tensile member is to be clamped the downwardly extending lip 72 of clamp member 69 engages the upper surface of outer leg 66 and as tension is applied to rock bolt 68 by nut 73, leg 66 is deformed to clamp tensile member 67 under compression.

Figure 31:
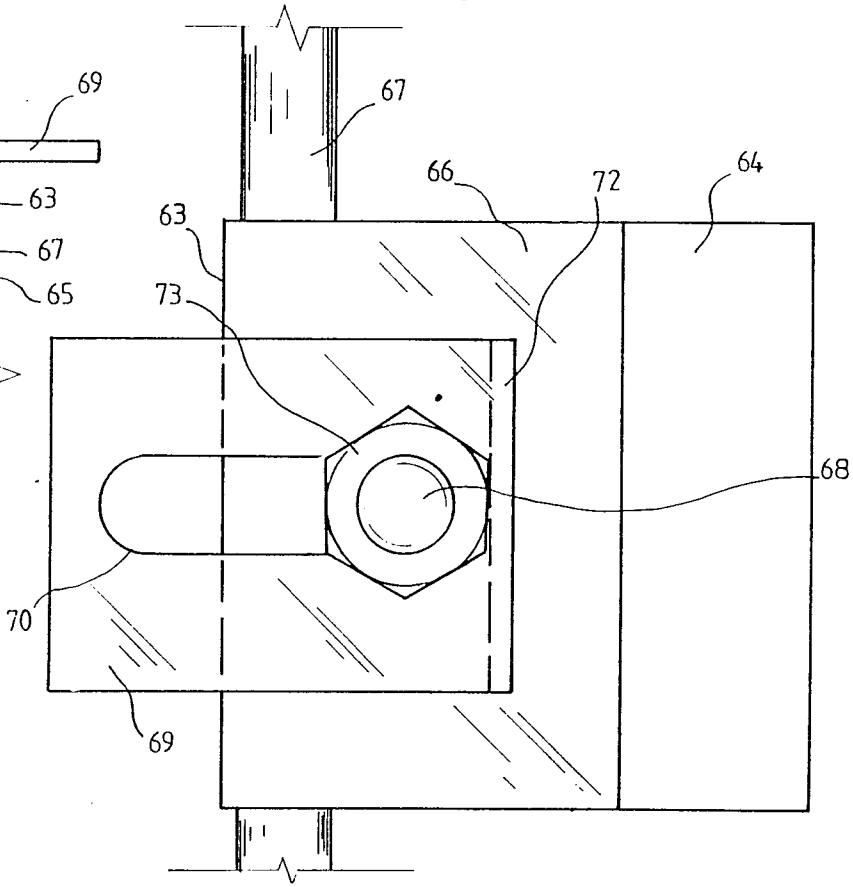
FIG. 31 is a plan view of the arrangement shown in FIG. 30.

FIG. 31 shows a plan view of the arrangement of FIG. 30.

What is claimed is:

1. A method of supporting and confining an earth formation wherein a plurality of anchor members are anchored into spaced boreholes in an exposed surface of the earth formation, each anchor member having connected thereto a tensile element lying against the surface of the earth formation and extending away from such anchor member towards an adjacent borehole, which method comprises connecting a free end of each tensile element to a captive portion of an adjacent tensile element connected to an anchor member anchored in such adjacent borehole, each tensile element being connected to the respective tensile element to form a substantially continuous tensile member extending linearly over the surface of the earth formation whereby in use such substantially continuous tensile member operates to distribute a load applied by the earth formation as a tensile stress in such substantially continuous tensile member along the connected tensile elements, and wherein a plurality of the anchor members and thereto connected tensile elements each is formed by a respective elongate U-shaped steel member bent intermediate its ends to form an L-shaped member having a first arm in the form of a closed loop and a second arm in the form of two free ends, the first arm forming the tensile element and the second arm forming the anchor member.

2. A method as claimed in claim 1, wherein the anchor members having tensile elements connected thereto are arranged in spaced boreholes in the earth formation to form a plurality of substantially continuous tensile members extending linearly over the surface of the earth formation.

3. A method as claimed in claim 2, wherein the substantially continous tensile members are arranged to extend parallel to each other across the surface of the earth formation.

4. A method as claimed in claim 3, wherein the parallel substantially continuous tensile members are interconnected at intervals to form a mesh-like array of substantially continuous tensile members interconnected by tensile elements extending transversely therebetween.

5. A method as claimed in claim 2, wherein the substantially continuous tensile members are arranged to extend across the surface of the earth formation in an angular relationship to form a mesh-like array with some substantially continuous tensile members overlying others.

6. A system for supporting and confining an earth formation comprising a plurality of anchor members anchored into spaced boreholes in an exposed surface of the earth formation, each anchor member having connected thereto a tensile element lying against the surface of the earth formation and extending away from the anchor member towards an adjacent borehole, a free end of each said tensile element being connected to a captive portion of a tensile element connected to an anchor member anchored in said adjacent borehole, each said tensile element being connected to a respective adjacent tensile element to form a substantially continuous tensile member extending linearly over the surface of the earth formation whereby in use said substantially continuous tensile member operates to dissipate a load applied by the earth formation as a tensile stress in said substantially continuous tensile member along said connected tensile elements, and wherein a plurality of said anchor members and thereto connected tensile elements each are formed by a respective elongate U-shaped steel member bent intermediate its ends to form an L-shaped member having a first arm in the form of a closed loop and a second arm in the form of two free ends, said first arm including the tensile element and said second arm including the anchor member.

7. A system as claimed in claim 6, wherein said anchor members having tensile elements connected thereto are arranged in spaced boreholes in the earth formation to form a plurality of substantially continuous tensile members extending linearly over the surface of the earth formation.

8. A system as claimed in claim 7, wherein said substantially continuous tensile members are arranged to extend parallel to each other across the surface of the earth formation.

9. A system as claimed in claim 8, wherein said parallel substantially continuous tensile members are interconnected at intervals to form a mesh-like array of substantially continuous tensile members interconnected by tensile elements extending transversely therebetween.

10. A system as claimed in claim 7, wherein said substantially continuous tensile members are arranged to extend across the surface of the earth formation in an angular relationship to form a mesh-like array with some substantially continuous tensile members overlying others.

11. A system for supporting and confining an earth formation comprising a plurality of restraining elements each having an L-shape providing an anchor portion and a tensile portion, at least one and another restraining element each being formed by an elongate rod-like steel member bent upon itself to provide a loop at the free end of the tensile portion and generally parallel sections coextending from said loop to form said tensile portion and then generally at right angles to said tensile portion to form said anchor portion, said one restraining element having its anchor portion anchored in a respective borehole in the earth formation with its tensile portion extending over the surfacce of the earth formation toward an adjacent borehole in which the anchor portion of said another restraining element is anchored, and said another restraining element at the captive end of its tensile portion passing through the loop at the free end of the tensile portion of said one restraining element thereby to connect the tensile portion of said one restraining element to the tensile portion of said another restraining element.

12. A system as set forth in claim 11, wherein respective pluralities of said restraining elements each have the tensile elements thereof connected to adjacent tensile elements thereof to form respective substantially continuous tensile members extending linearly over the surface of the earth formation, and said substantially continuous tensile members are arranged to extend generally parallel to each other across the surface of the earth formation.

13. A system as set forth in claim 12, wherein said generally parallel substantially continuous tensile members are interconnected at intervals by other said restraining elements extending transversely therebetween to form a mesh-like array of substantially continuous tensile members.

14. A system as set forth in claim 11, wherein respective pluralities of said restraining elements each has the tensile elements thereof connected to adjacent tensile elements thereof to form respective substantially continuous tensile members extending linearly over the surface of the earth formation, and said substantially continuous members are arranged to extend across the surface of the earth formation in an angular relationship to form a mesh-like array with some substantially continuous tensile members overlying others.

15. A system for supporting and confining an earth formation comprising a plurality of restraining elements each having an anchor portion and a tensile portion extending generally at right angles to each other, said restraining elements being formed from elongate rod-like steel members and said tensile portion being bent at its free end first in a direction perpendicular to the anchor portion and then in a direction parallel to the anchor portion to form a hook, at least one said restraining element having its anchor portion anchored in a respective borehole in the earth formation with its tensile portion extending over the surface of the earth formation towards an adjacent borehole in which the anchor portion of another said restraining element is anchored, and said another restraining element at the captive end of its tensile portion having interlocked therewith the hook at the free end of the tensile portion of said one restraining element thereby to connect the tensile portion of said one restraining element to the tensile portion of said another restraining element.

16. A system as set forth in claim 15, wherein respective pluralities of said restraining elements each have the tensile elements thereof connected to adjacent tensile elements thereof to form respective substantially continuous tensile members extending linearly over the surface of the earth formation, and said substantially continuous tensile members are arranged to extend generally parallel to each other across the surface of the earth formation.

17. A system as set forth in claim 16, wherein said generally parallel substantially continuous tensile members are interconnected at intervals by other said restraining elements extending transversely therebetween to form a mesh-like array of substantially continuous tensile members.

18. A system as set forth in claim 15, wherein respective pluralities of said restraining elements each has the tensile elements thereof connected to adjacent tensile elements thereof to form respective substantially continuous tensile members extending linearly over the surface of the earth formation, and said substantially continuous members are arranged to extend across the surface of the earth formation in an angular relationship to form a mesh-like array with some substantially continuous tensile members overlying others.

19. A system for supporting and confining an earth formation comprising a plurality of tensile elements each being formed by an elongate steel member bent to form a loop at each end, said tensile elements extending across the surface of the earth formation with loops at the ends of said tensile elements overlapping loops at the ends of other tensile elements at respective boreholes in the surface of the earth formation, and rock bolts anchored in said boreholes, said rock bolts having stems extending through said respective overlapped loops of said tensile elements to interconnect said tensile elements.

20. A system as set forth in claim 19, wherein respective pluralities of said tensile elements each have adjacent tensile elements thereof connected by said rock bolts to form respective substantially continuous tensile members extending linearly over the surface of the earth formation, and said substantially continuous tensile members are arranged to extend generally parallel to each other across the surface of the earth formation.

21. A system as set forth in claim 20, wherein said generally parallel substantially continuous tensile members are interconnected at intervals by other said tensile elements extending transversely therebetween to form a mesh-like array of substantially continuous tensile members.

22. A system as set forth in claim 19, wherein respective pluralities of said tensile elements each have adjacent tensile elements thereof connected by said rock bolts to form respective substantially continuous tensile members extending linearly over the surface of the earth formation, and said substantially continuous tensile members are arranged to extend across the surface of the earth formation in an angular relationship to form a mesh-like array with some substantially continuous tensile members overlying others.

* * * * *